United States Patent [19]

Brooks

[11] Patent Number: 4,848,203

[45] Date of Patent: Jul. 18, 1989

[54] ADJUSTABLE RIP FENCE FOR WOOD WORKING MACHINES

[76] Inventor: Kenneth P. Brooks, 683 Anderson Ave., Brentwood, Calif. 94513

[21] Appl. No.: 226,687

[22] Filed: Aug. 1, 1988

[51] Int. Cl.[4] ..... B26D 7/06; B27C 1/12

[52] U.S. Cl. ..... 83/438; 144/253 R

[58] Field of Search ..... 83/438; 144/253 R

[56] References Cited

U.S. PATENT DOCUMENTS

| | | | |
|---|---|---|---|
| 2,744,549 | 5/1956 | Johnson | 83/438 |
| 3,011,531 | 12/1961 | Gaskell | 83/438 |
| 3,963,279 | 6/1976 | Eichler | 83/438 |
| 4,206,910 | 6/1980 | Biesemeyer | 83/438 |

*Primary Examiner*—W. Donald Bray

*Attorney, Agent, or Firm*—Owen, Wickersham and Erickson

[57] ABSTRACT

A movable rip fence is adapted for installation on the work table having a planar surface with a pair of rails on opposite sides that are provided with a series of evenly spaced apart holes, and with a cutting tool between the rails that extends above the table surface. The fence comprises an elongated main frame unit that extends between the rails including movable pins at opposite ends for holding the main frame unit generally perpendicular to both rails. A first control device on the main frame which enables the pins to be inserted and retracted into and out from a preselected pair of holes in the rails to first hold the main frame firmly in a predetermined fixed position and thereafter release it for movement to another position. An elongated guide member having an outer planar surface is positioned adjacent and parallel to the main frame and is yieldably attached to it. A second control device is provided for moving the guide member laterally relative to said main frame in a precise manner so as to position its outer planar surface a desired distance from the cutting tool on the rack table. A storage rack is provided at one end of the table to receive and retain the rip fence when it is not in use.

20 Claims, 5 Drawing Sheets

ADJUSTABLE RIP FENCE FOR WOOD WORKING MACHINES

Specification

This invention relates to wood working machines and more particularly to an improved rip fence for use on such machines for guiding or holding a work piece as it is being sawed, shaped or sanded.

BACKGROUND OF THE INVENTION

On woodworking machine tools such as tablesaws, jig or band saws, shapers, sanders and the like, an adjustable fence has long been used as a guide for positioning the wood workpiece being sawed or shaped. Heretofore, such fences often tended to move or "walk away" from their set position due to pressure from the wood being cut. Even a slight movement of the fence often reduced the precision and accuracy of the sawing operation. Also, prior fences on saw tables were inherently difficult to adjust within close tolerances in order to provide a desired dimensional result and account for the thickness of the saw blade.

Accordingly, one object of the present invention is to provide an improved fence for a saw table that solves the aforesaid problems of prior art fences.

Another object of the invention is to provide a rip fence which can be set with precision in a fixed position on a saw table so that it will not "walk-away" or otherwise move despite any amount of side force applied to the fence.

Yet another object of the invention is to provide a fence for a wood-working table that can be easily moved along the table to a preselected position or to a storage location.

Another object of the invention is to provide an improved fence for a work table having side rails which has a first frame section that can be rigidly attached to the side rails in a fixed position and a second guide member attached to the frame section which is movable laterally relative to the frame section in order to position the guide member at a precise distance from a cutting tool on the table.

Another object of the invention is to provide a fence for a wood-working table that is strong, durable and particularly well adapted for ease and economy of manufacture.

SUMMARY OF THE INVENTION

In accordance with the principles of the invention an improved rip fence is provided which is adapted for installation on a planar table having a pair of parallel rails that are attached to and extend along opposite sides of the table. Each of these rails is provided with a series of evenly spaced apart precision reamed holes along its length. The holes of both rails are aligned transversely across the table so that a line connecting the centers of each pair of aligned holes is precisely perpendicular to the rails and also parallel with a motorized saw blade extending above the table.

The fence assembly comprises a main frame in combination with a connected guide member that is generally parallel and moveable, relative to the main frame. The guide member is held firmly, to the main frame by a yieldable means. A hand operated control means operates a mechanism on the main frame which moves the guide member laterally relative to the main frame by precise amounts which are measured by an indicator means.

At each of its opposite ends, the main frame has a pair of tapered pins which fit into selected pairs of tapered holes in the rails to hold the fence in a preset location A pin actuating means is provided in the main frame which is adapted to engage and lift the pins when the fence is to be moved laterally on the table and to reinsert the pins at a new selected location. A pair of rollers are journaled at opposite ends of the main frame and guide member to enable the fence to be moved on the saw table.

In use, the fence assembly is placed on the saw table and moved so that its tapered end pins can be inserted into a preselected pair of holes marked for the nearest whole inch of the desired cut. A crank on the main frame is then turned to move the guide member laterally until the desired fraction of an inch is shown on the indicator. With the fence firmly held by its end pins in a substantially non-yielding but precisely located position, the saw cut on the wood workpiece can be made. When not in use, the invention provides a means for storing the moveable fence in a retractable end or side section of the table.

Other objects, advantages and features of the invention will become apparent from the following detailed description of one embodiment thereof, presented in conjunction with the accompanying drawing.

DETAILED DESCRIPTION OF EMBODIMENT

Figure 1:
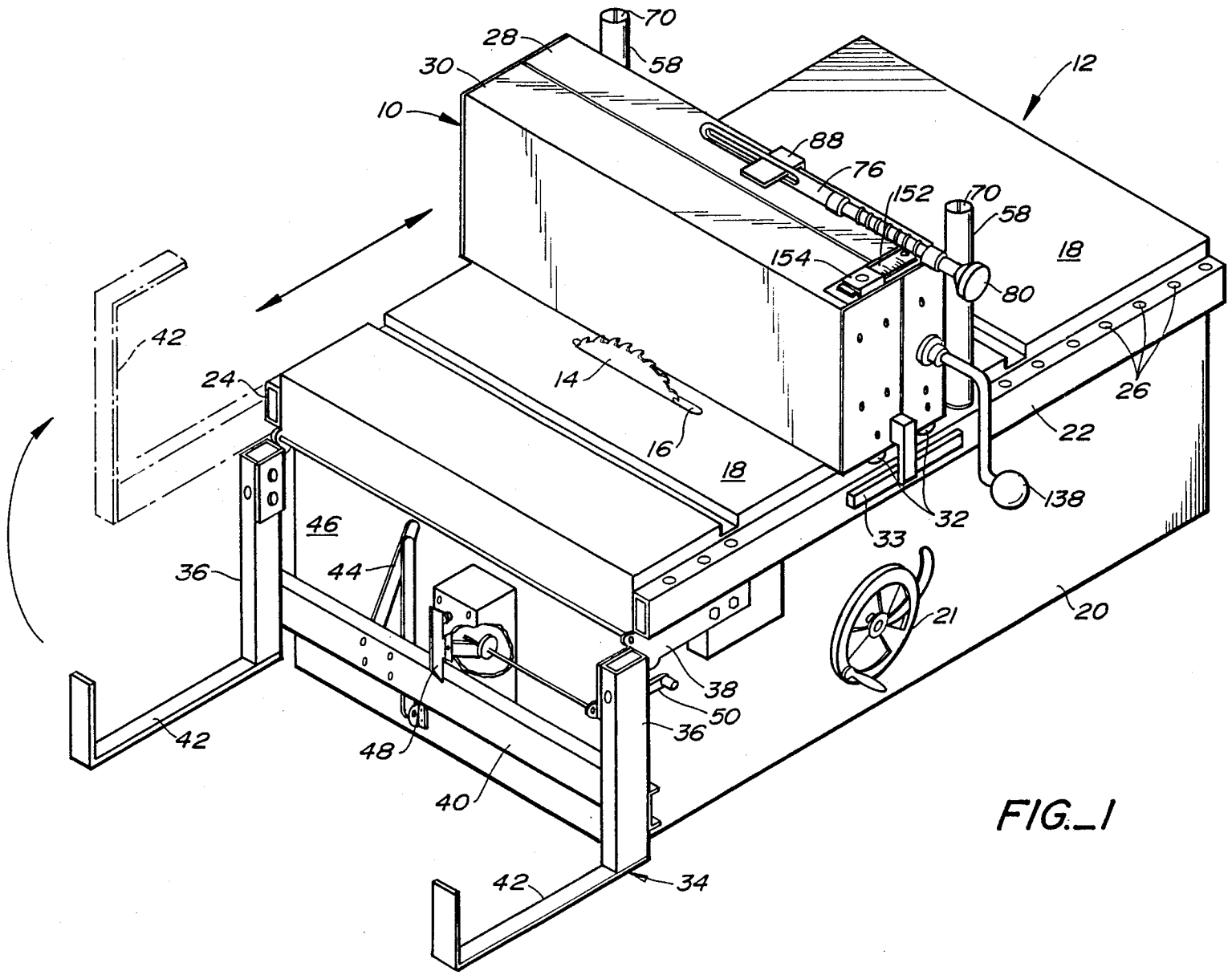
FIG. 1 is a view in perspective of a table saw with a adjustable fence according to the present invention.

With reference to the drawing FIG. 1 shows a rip fence 10 according to the present invention as it appears when mounted for use on a saw table 12 having a circular saw 14. The saw extends through a slot 16 in the table platen 18 which is attached to a base frame 20. The saw is adjustable up and down by conventional mechanism; not shown, which is controlled by a wheel 21.

The rip fence 10 is parallel to the saw blade and its distance from the blade is adjustable by two separate means in a precise manner, in accordance with the principles of the invention.

The platen 18 is generally rectangular in shape. Attached to its front and rear side edges are a pair of elongated front and rear rail members 22 and 24 each having a series of holes 26 that are evenly spaced apart along their length, e.g. one inch on centers. Each rail member is preferably a rigid extruded member with a box shaped cross section having upper and lower horizontal web portions. The spaced apart holes along the length of each rail member are provided in vertically aligned pairs that extend through both upper and lower web portions. The holes in the upper we portions of the rails are reamed with precision and are somewhat larger than the holes directly below in the lower web portion, so that a tapered pin will fit snugly in the vertically aligned holes. Also, pairs of holes in the two rail members, are aligned across the table so that a straight line through the centers or each successive pair of holes on opposite sides of the saw table is parallel with the plane of the saw blade.

In broad terms, the rip fence 10 comprises two sections including a main frame section 28 and a moveable guide section 30 which are connected together as a unit that is itself movable across the platen of the table saw to a preselected location in order to provide a barrier that enables the saw to cut material to a predetermined dimension equal to the distance between the barrier and the saw blade. The combined rip fence unit is also supported on rollers 32 so as to be easily moveable along the platen over the saw blade and onto a storage rack 34 at one end of the platen.

Figure 2:
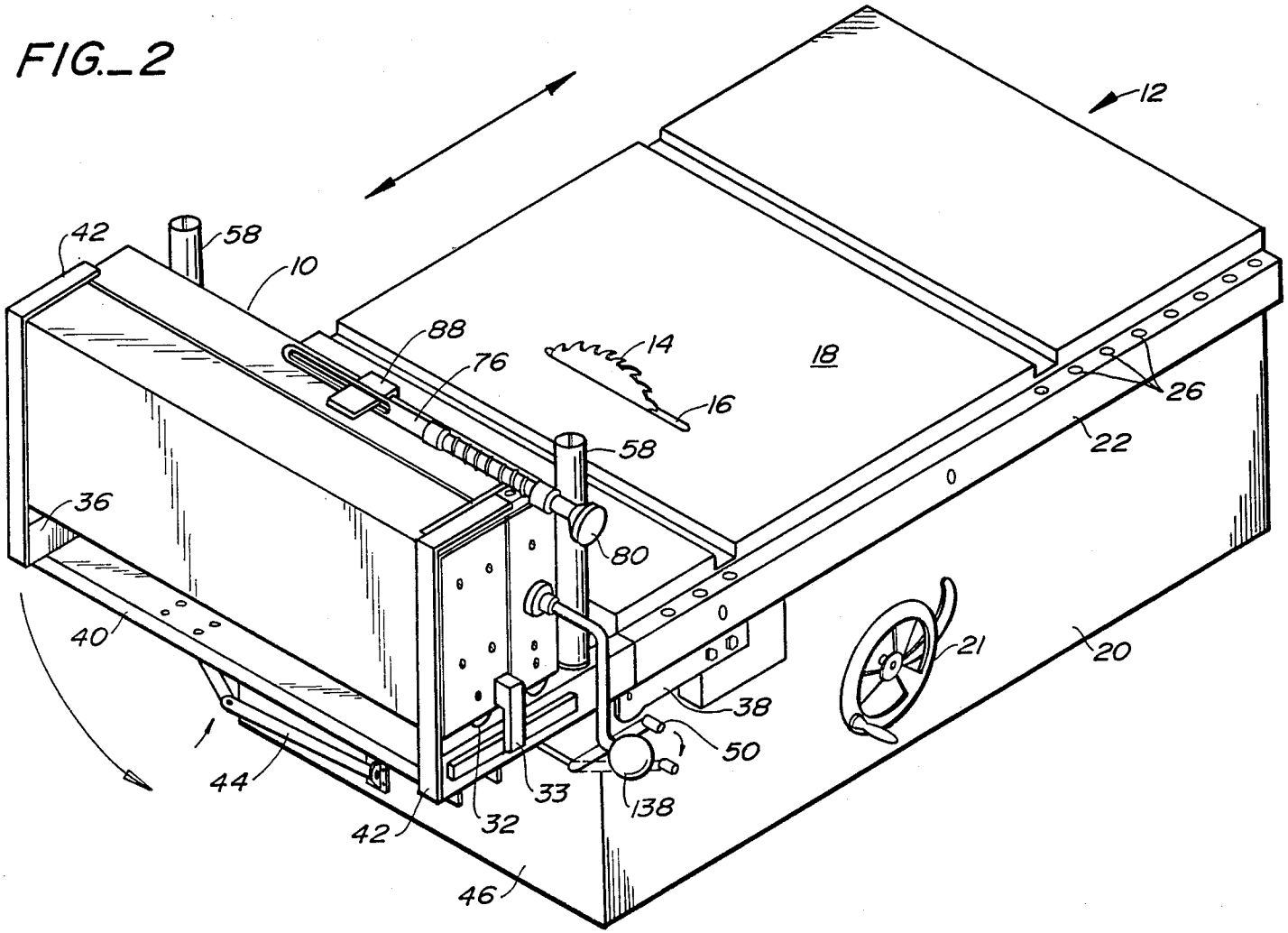
FIG. 2 is a view in perspective similar to FIG. 1, showing the fence being moved to its stored position.

The rack 34 comprises a pair of side rail extensions 36 that are supported by spring loaded or counter balanced hinges 38 on opposite sides of the base frame 20 and are aligned with the side rail members 22 and 24 when the rack is in the "up" position, as shown in FIG. 2. These hinges are spring loaded or counter weighted to compensate for rip fence weight when it is lowered into its stored position. The rail extensions are connected by a cross member 40, and an L-shaped bracket 42 is fixed to the outer end of each beam extension. A double link support bracket 44 connected to the cross member 40 and the end wall 46 of the base frame serves to hold the storage rack 34 in its up position. A pair of rip fence guides 33 are attached to the ends of the guide member 30 and bear against outside vertical walls of rails 22 and 24 to keep the rollers 32 aligned on the top surface of the rails and their extensions 36.

When the storage rack is up, the rip fence assembly can be rolled onto it so that the guide section 30 bears against the L-shaped end brackets 42. The rollers 32 at both ends of the fence assembly move along the top surfaces of the two rail members 22 and 24. When in the aforesaid storage position, the support bracket 44 is released to allow the rack 34 to pivot downwardly at one end or the platen. In this position a locking latch member 48 is cammed over the cross member 40 to retain it in place. When the fence is to be used again, the rack 34 is released for an upward pivoting movement actuation of a lever 50 that moves the latch member 48 away from the cross member 40.

Figure 3:
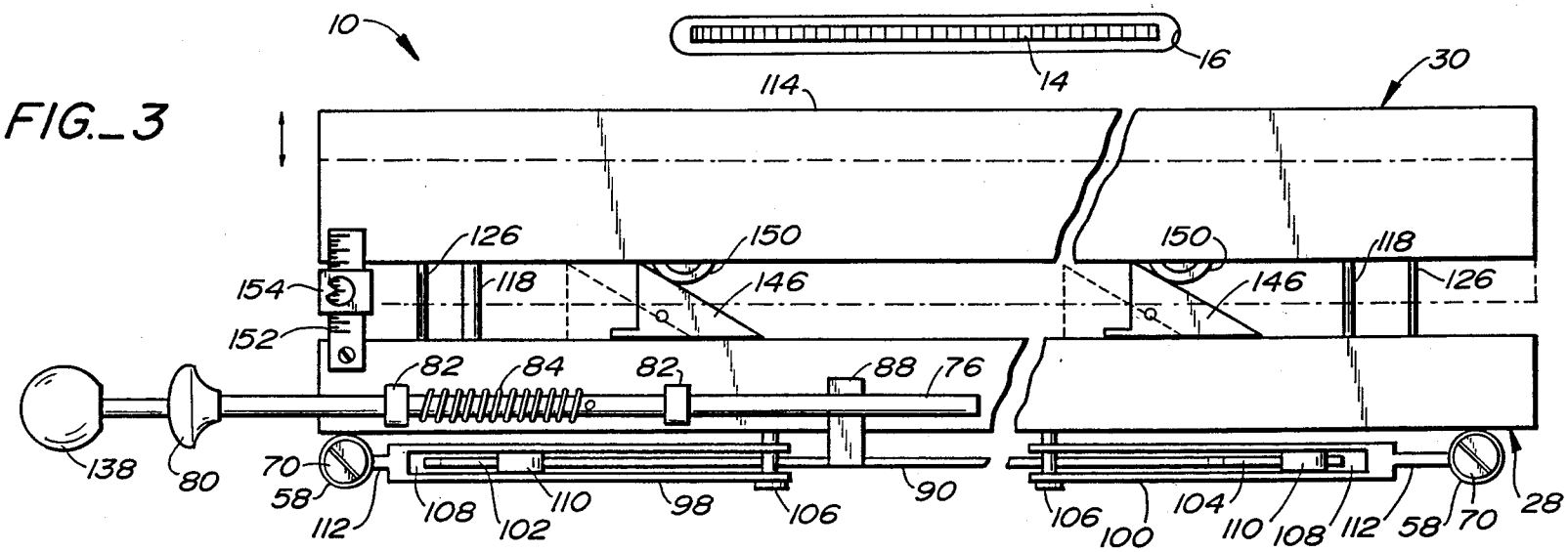
FIG. 3 is a fragmentary top view of the fence as it appear with its guide section extended on a table saw.
Figure 4:
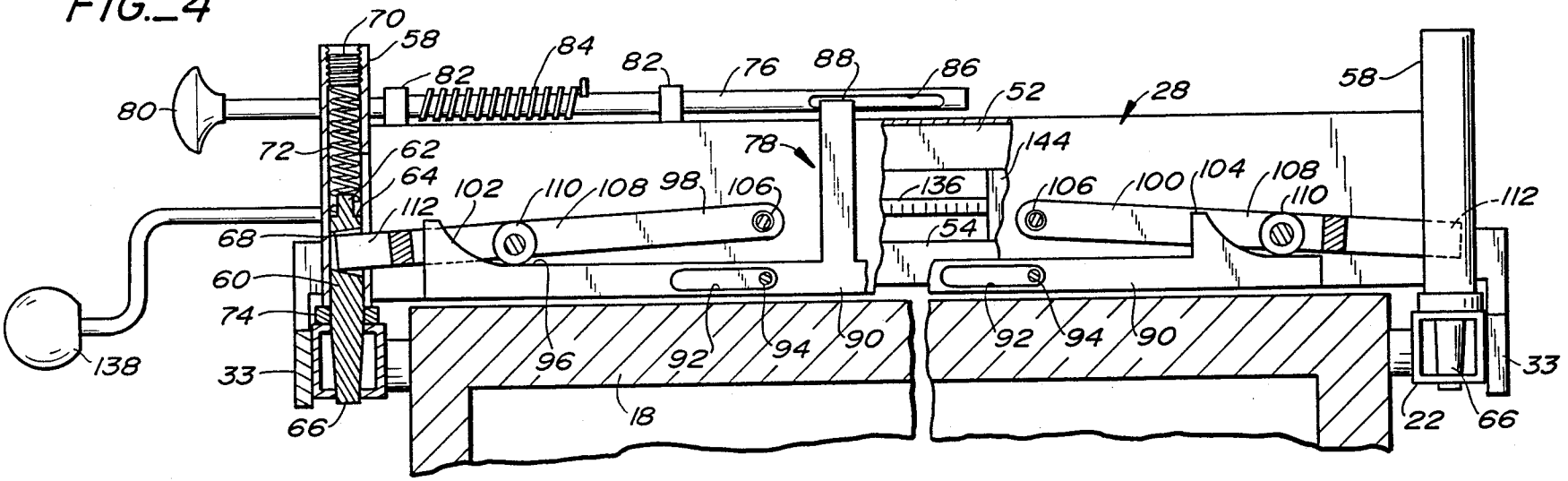
FIG. 4 is a view in side elevation and partially in section showing the pin-locked section and the pin control linkage of the saw fence according to the invention.
Figure 5:
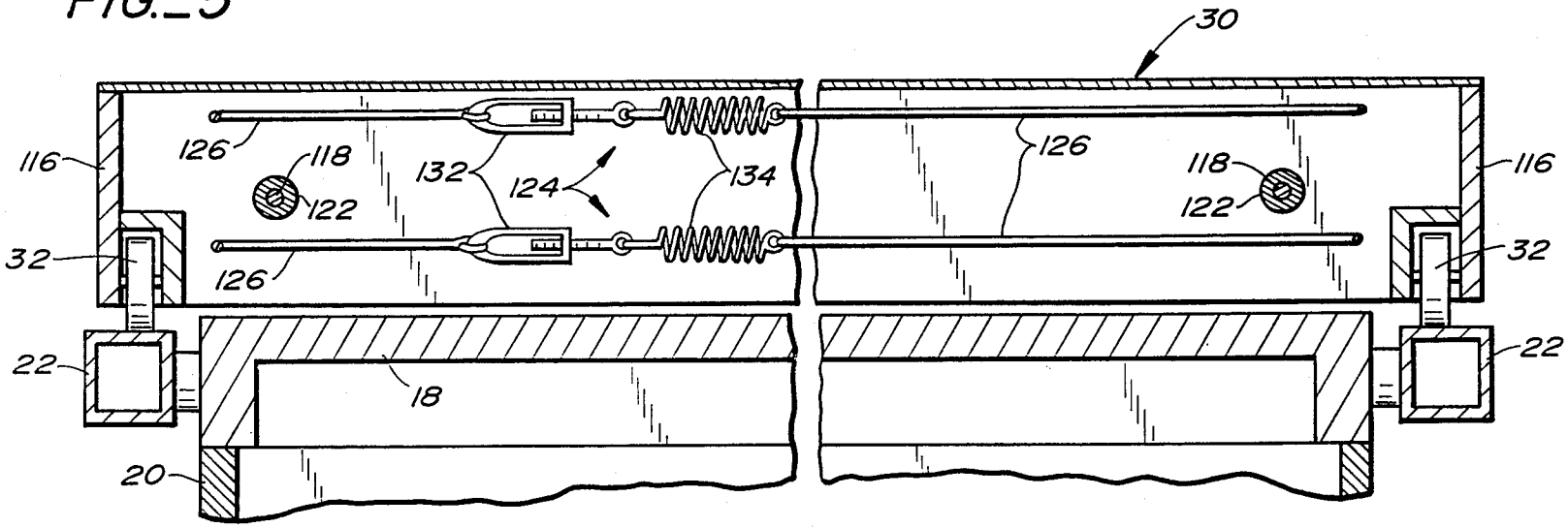
FIG. 5 is a view in elevation and in section of the saw fence guide section taken along line 5—5 of FIG. 3A.

Turning now to FIGS. 3–5, the various components of the rip fence 10 according to the invention are shown in greater detail. The main frame section 28 comprises a rigid structure, preferably formed from a pair of upper and lower box beams 52 and 54 that are long enough to extend between the front and rear rails attached to the saw table. These beams are vertically spaced apart about one inch and are held together by spacers 56 to form a rectangular frame that contains the working mechanism. Fixed to opposite ends of the base frame are a pair of guide sleeves 5B, each of which contains a tapered pin 60. These pins are movable up and down and are adapted to fit into preselected holes 26 in the rails 22 and 24 for the table to hold the main frame at a preselected location.

Each pin 60 has a main cylindrical body having a constant diameter from which extends an upper end portion 62 having a smaller diameter, thereby forming an annular shoulder 64 at the upper end of the body. Extending below the main body is a lower tapered portion 66 of the pin that is sized to fit snugly into the holes 26 of the rails. Extending longitudinally within the main body of each pin is a slot 68 having a uniform width which is aligned with a slot 113 in the surrounding sleeve 58. Seated on the shoulder 64 and retained by a threaded cap 70 in the pin sleeve is a coiled spring 72 which urges the pin downwardly within its sleeve. The lower end of each pin is provided with an annular guide member 74 which keeps the fence from tipping when the pins are extracted.

The up and down movement of the two pins 60 at opposite ends of the main frame section 28 serves to secure the main frame of the fence in a pair of preselected holes 26 in the rails and is controllable by an elongated rod 76 attached to a lifting lever linkage 78 fixed to one side of the main frame. As shown in FIG. 4, the rod 86 has a knob 80 at one end and is supported in a pair of spaced apart guides 82 fixed to the top side of the main frame. Extending around the rod 76 between the guides 82 is a coiled spring 84. This spring enables the rod 76 to be moved axially back and forth and thereby serve as a slide banner to knock the pins loose when they are to be extracted for movement of the fence. Near one end of the rod 76 is an elongated slot 86 and extending through it is one end of an inverted L-shaped tongue portion 88 that extends from a movable actuating link 90. Thus, as the control rod 76 is moved longitudinally, the attached actuating link 90 is moved in the same direction. The actuating link has a pair of slots 92 spaced from and extending longitudinally from opposite sides of the tongue portion 88. A bolt 94 extends through each slot and is threaded into the main frame section, thereby enabling the actuating link to be supported by these bolts 94 while being moved back and forth on them for the length of the slots.

A top edge surface 96 of the actuating link provides a cam track for two pivotal links 98 and 100. Near opposite ends of the actuating portions of this top edge surface, it curves upwardly to form a pair of lifting cam portions 102, and 104 as shown in FIG. 4.

Each pivotal link 98, 100 is connected to the side of the main frame section by a bolt 106 so as to readily pivotal about that point. Preferably, each of the latter bolts is located directly above a retaining bolt 94 for the actuating link 90. Each pivotal link has a main body portion with a slot 108 within which is journaled a roller 110 that serves as a cam follower. Extending beyond the body portion is a tongue member 112 that fits through a slot 113 in a sleeve and also within the slot 68 of a tapered pin 60.

Figure 4A:
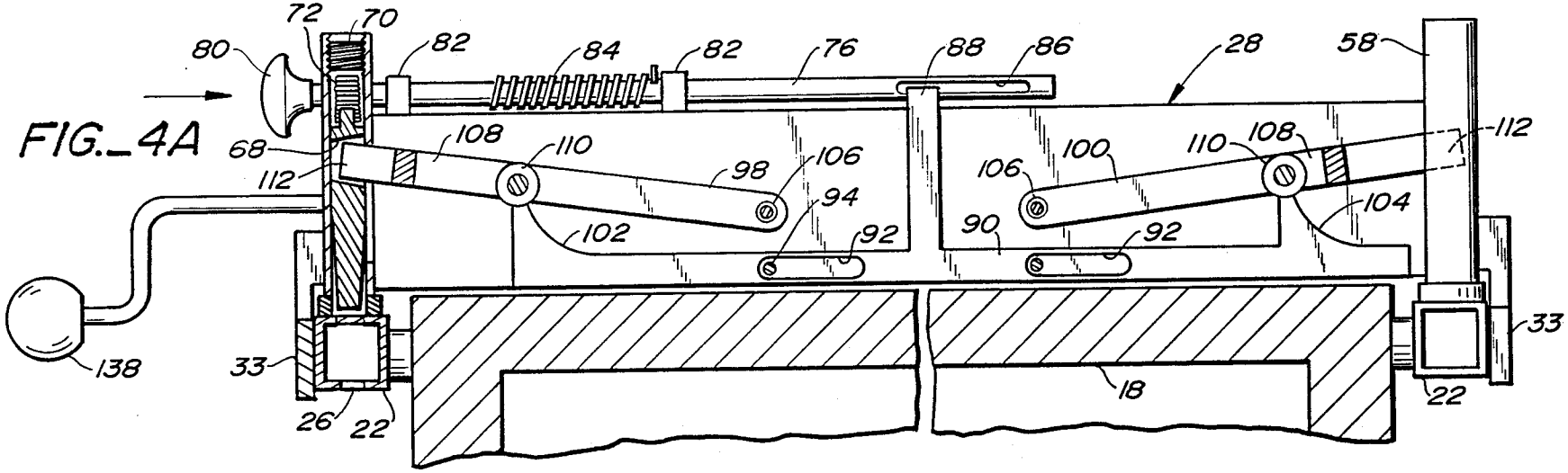
FIG. 4A is a view in elevation similar to FIG. 4, showing the locking pins removed by the pin control mechanism.

As shown in FIGS. 4 and 4A, axial movement of the control rod 80 moves the actuating link in the same direction. Thus, if the pins 60 are already within one pair of holes in the rails, the pivotal links 98, 100 are positioned with their followers 110 on the flat portion of the cam track. Now, when the control rod 80 and thus the actuating link 90 is moved longitudinally, the link followers are moved up the lifting portions 102, 104 of the cam track and the pins 90 at each end of the main frame are force upward and out of the rail holes. When the rip fence 10 is move laterally on the saw table to another set of rail holes, the control rod can 80 be reversed to move the actuating link and the pivotal links again in the opposite direction to cause the pins to drop into place.

As stated above, the guide section 30 for the rip fence 10 is moveable with respect to the main frame section 28 while being precisely parallel to it at all times. The guide section is a elongated rigid member, preferably an aluminum casting, having a outer wall 114 and attached end members 116 and a length substantially equal to that of the main frame member. The outer wall is preferably faced with a layer of smooth hardwood which may be bonded thereto using a suitable adhesive.

The attached end members on the elongated guide member form channels at its opposite ends within which are mounted rollers 32 that support the guide member 30 on the rails 22 and 24.

Extending transversely from the inside wall of the guide member are a pair of space apart guide rods 118 which fit into a pair of blocks 120 on the main frame. These blocks 120 are fixed to the main frame assembly between the upper and lower box beams 52 and 54. The other ends of the guide rods 118 are slidable within a pair of aligned sleeves 122 fixed to an inner side panel of the guide member 30.

Figure 3A:
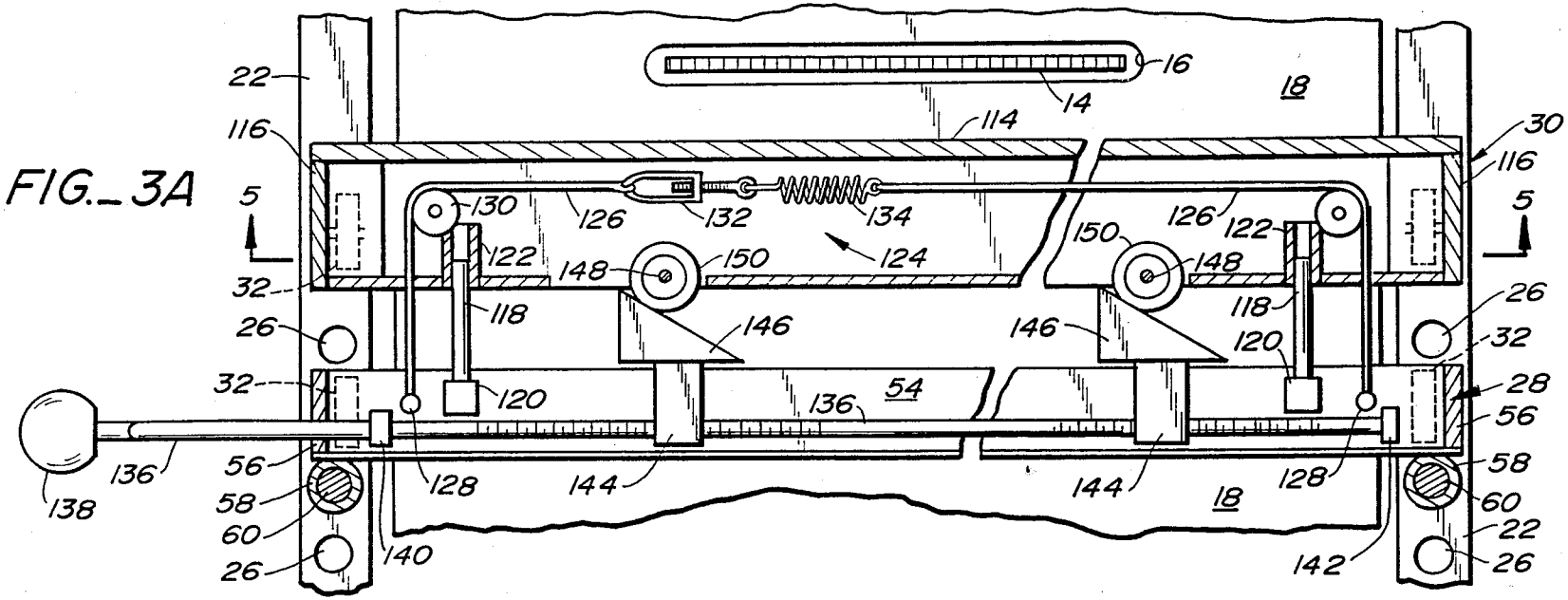
FIG. 3A is a view in section taken along line 3A—3A of FIG. 4 and similar to FIG. 3 showing the guide section with its cover removed.

As shown in FIGS. 3A and 5, the guide member 30 is held to the main frame by a pair of upper and lower spring cable devices 124. Each of the latter devices comprises a length of flexible wire or cable 126 which is fixed at its opposite ends by suitable anchor means 128 to the main frame. Each flexible cable extends around a pair of pulleys 130 mounted near opposite ends of the guide member. Between each aforesaid pair of pulleys, each cable is connected to a turnbuckle 132 and a coiled spring 134. The turnbuckle allows for a degree cf adjustment in the cable tension and the spring maintains the proper cable tension as the guide member is moved relative to the main frame.

Turning now to FIGS. 3 and 3A, the means for moving the guide member 30 laterally relative to the main frame is shown. On the main frame 28 an elongated threaded control rod 136 is provide which has a crank handle 138 or control knob at one end. This control rod is supported in a first bushing 140 and an end bushing 142 both of which are fixed to the main frame.

Threaded to the control rod at spaced apart locations are pair of mounting blocks 144. Fixed to each mounting block and extending outwardly therefrom is a wedge shaped cam 146. The mounting blocks are partially restrained so that as the threaded control rod 136 is turned, the blocks and thus their attached wedge shaped cams 146 move axially. The blocks 144 move between and thus are guided by the upper and lower beams 52 and 54.

Mounted on the guide member 30 by axle members 148 fixed to it at spaced apart locations, are a pair of rollers 150 that serve as followers for the cams 146. Now, when the control rod 136 is turned by its hand crank 138, the wedge shaped cams 146 move along the rollers 150 on the guide member and push it away against the tension afforded by the springs 134 in the two cable devices 124. The sliding guide rods 118 maintain a precise alignment of the guide member 30 so that as it moves in and out laterally with respect to the main frame 28 it is always parallel to it.

An indicator 152 with appropriate dimensional graduations is attached to the top of the main frame 28 and extends laterally over the moveable guide member 30. By setting a movable marker 154 on the indicator, after calibration with the actual distance between the saw blade and the outer surface of the guide member wall, the precise dimension for a prospective saw cut can be set.

In operation, the fence 10 is placed on the saw table with the tapered pins 60 in the selected holes that are marked for the whole inch of the desired cut. The whole inches are stamped on the top of the rails. The crank 138 on the main frame 28 for movement of the guide member 30 is then turned until the desired fraction of an inch is shown on the indicator 152. As the crank and thus the control rod 136 is turned, the guide member is moved laterally a precise amount. The cut is then ready to be made.

When the fence 10 is moved to a new location the lifting knob is pushed away from the operator and then pulled and released to jar the pins loose. The knob is then pushed to lift the pins 60 from their respective rail holes. The fence is then rolled across the table to the new desire location. As the fence is moved cam shape causes the pins to stay in their up position until the rod is pulled. The control knob is then pulled toward operator and the pins are inserted into the holes at the new location. The control crank for the guide member is then turned to give the proper fraction of an inch between the guide member outer surface and the saw blade, and again the cut is ready to be made.

Several other advantages are readily apparent with the rip fence 10 according to the present invention. For example, the fence can be removed from the saw and returned to exactly the same setting without making any adjustments. The fence cannot "walk away" from the saw blade due to pressure from the wood being cut because it is solidly retained by the guide member and the main frame pins.

Other advantages include the fact that the readout indicator 152 can be adjusted easily for the thickness of the saw blade; the fence can be adjusted to cut a small taper if desired; and the fence may be removed from the saw in any position.

If desired, the fence 10 may be reversed on the saw table to cut on the left side of the blade. This only requires the crank to be inserted in the other end of the main frame and the indicator adjusted for the new distance from the saw blade. A further advantage lies in the fact that the fence does not depend on a locking mechanism that may come loose unexpectedly, and it will not get out of square with the saw during use, a problem that was quite common with prior fence designs.

To those skilled in the art to which this invention relates, many changes in construction and widely differing embodiments and application of the invention will themselves without departing from the spirit and scope of the invention. The disclosure and the description herein are purely illustrative and are not intended to be in any sense limiting.

What is claimed is:

1. In combination with a work table having a planar surface, a pair of rails on opposite sides of said surface, each rail having a series of evenly spaced apart holes, a cutting tool between said rails extending above said table surface, a movable fence adapted for installation on the work table comprising:

an elongated main frame means extending between said rails including pin means at opposite ends of said frame means for holding said main frame means generally perpendicular to both said rails;

first control means for inserting and retracting said pin means into and out from a preselected pair of said holes in said rails;

an elongated guide member having an outer planar surface and positioned adjacent and parallel to said main frame said guide member including yieldable means for connecting said guide member to said main frame means, and a second control means for moving said guide member laterally relative to said main frame means so as to position its outer planar surface a precise distance from said cutting tool on the work table.

2. The fence assembly as described in claim 1 wherein said first control means comprises link means pivotally attached to said frame means and engaging said pin means; cam actuator means engaging said link means; and manual actuator means connected to said cam actuator means for moving said cam actuator means and thereby said pivoted links to insert and withdraw said pins in said rails.

3. The fence assembly as described in claim 1 wherein said yieldable means for connecting said guide member to said main frame comprises at least one cable anchored on said main frame; and spring means in said cable for providing a constant force tending to urge said guide member and said frame means together.

4. The fence assembly as described in claim 3 wherein said yieldable means comprises two vertically spaced apart cables, each having a spring means.

5. The fence assembly as described in claim 1 wherein said second control means comprises a plurality of spaced apart ca means on said main frame and an equal number of cam follower attached to said guide member, each said cam means being i contact with a said follower, and controllable means for moving said cam means longitudinally on said main frame to cause resultant lateral movement of said guide member.

6. The fence assembly as described in claim 5 including a pair of sliding transverse means extending between said main frame means and said guide means.

7. The fence assembly as described in claim 5 wherein said cam means on said main frame means comprises a pair of triangular shaped members which engage with said cam followers.

8. The fence assembly as described in claim 5 wherein said controllable means comprises an elongated threaded rod connected to a hand crank, each said cam means being threaded to said rod so as to move longitudinally when the rod is rotated.

9. The fence assembly as described in claim 1 including rollers attached to the ends of said main frame means and said guide member and adapted to engage said rails.

10. The fence assembly as described in claim 1 wherein each said rail has upper and lower web portions, said upper web portion having said spaced apart holes and said lower web portion also having holes that are vertically aligned with and somewhat smaller than said holes in said upper web portion; and wherein said pin means comprises vertically slidable pins having a lower tapered portion that fits with both vertically aligned holes of said rail web portions.

11. The fence assembly as described in claim 10 wherein said pin means further includes spring means for urging each said slidable pin in a downward direction.

12. The fence assembly as described in claim 9 including pair of guide means attached to the ends of said movable fence and extending downwardly adjacent said rails for maintaining the alignment of said rollers on said rails.

13. The fence assembly as described in claim 9 including storage rack at one end of the table for retaining said fence when it is not in use.

14. The fence assembly as described in claim 10 wherein said storage rack includes extended rail members hinged to the ends of said rails; retaining brackets on the ends of said extended rail members; and adjustable support means for holding said extended rail members in a horizontal position for receiving the rip fence and for allowing said rail members to pivot downwardly in vertical position to retain said fence.

15. The fence assembly as described in claim 14 including controllable latch means for securing said storage rack in its vertical, fence storing position.

16. In combination with a work table having a planar surface a pair of rails on opposite sides of said surface, each rail having a series of evenly spaced apart holes, a circular saw between said rails extending above said table surface, a moveable fence adapted for installation on the work table comprising:

an elongated main frame means extending between said rails including movable pin means at opposite ends of said frame means for holding said main frame means generally perpendicular to both said rails;

a first control means for inserting and retracting said pin means into and out from a preselected pair of said holes in said rails;

an elongated guide member having an outer planar surface and positioned adjacent and parallel to said main frame an to said circular saw, said guide member including yieldable mean for connecting it to said main frame means, and a second control means including cam means for moving said guide member laterally relative to said main frame means s as to position its outer planar surface a precise distance from said circular saw on the work table.

17. The fence assembly as described in claim 16 including presetable indicator means for displaying the precise distance or said outer planar surface of said guide member from said circular saw whenever the guide member is moved by said second control means.

18. The fence assembly as described in claim 17 wherein said indicator means comprises a graduated member with distance indicating indicia which is attached to said frame means and extends over said guide member.

19. The fence assembly as described in claim 16 wherein said mean frame means comprises a pair of elongated vertically space apart beam members, end means for connecting said beam members together, said second control means comprising a threaded rod supported by said end means and extending parallel to and between said beam members.

20. The fence assembly as described in claim 19 wherein said second control means further includes a pair of spaced apart support blocks threaded to said rod and movable between said beam members, and means connecting said cam means to said support blocks.

* * * * *

UNITED STATES PATENT AND TRADEMARK OFFICE

CERTIFICATE OF CORRECTION

PATENT NO. : 4,848,203

DATED : July 18, 1989

INVENTOR(S) : KENNETH P. BROOKS

It is certified that error appears in the above-identified patent and that said Letters Patent is hereby corrected as shown below:

Col. 1, line 65, the comma after "firmly" should be deleted.
Col. 2, line 31, "a" should be --an--.
line 36, "appear" should be --appears--.
Col. 3, line 3, "we" should be --web--.
line 48, "or" should be --of--.

line 66, "force" should be --forced--.
line 67, "move" should be --moved--.

Col. 5, line 7, "a" should be --an--.
line 8, "a" should be --an--.
line 41, "provide" should be --provided--.

Col. 7, line 1, before "first", --a-- should be inserted.
line 32, "ca" should be --cam--.
line 33, "follower" should be --followers--.
line 34, "i" should be --in--.
Col. 8, line 2, before "pair", --a-- should be inserted.
line 7, before "storage", --a-- should be inserted.
line 36, "an" should be --and--.
line 42, "s" should be --so--.
line 46, "or" should be --of--.

Signed and Sealed this

Twenty-second Day of January, 1991

*Attest:*

HARRY F. MANBECK, JR.

*Attesting Officer*

*Commissioner of Patents and Trademarks*